US008701621B2

(12) United States Patent
Takeda et al.

(10) Patent No.: US 8,701,621 B2
(45) Date of Patent: Apr. 22, 2014

(54) FOUR-CYCLE ENGINE, BUSH CUTTER AND ENGINE-DRIVEN TOOL HAVING SAME

(75) Inventors: Takeshi Takeda, Hitachinaka (JP); Takamoto Horiuchi, Hitachinaka (JP); Hiroshi Ohira, Hitachinaka (JP); Takahiro Hirai, Hitachinaka (JP); Katsumi Kurihara, Nagoya (JP)

(73) Assignee: Hitachi Koki Co., Ltd., Tokyo (JP)

( * ) Notice: Subject to any disclaimer, the term of this patent is extended or adjusted under 35 U.S.C. 154(b) by 10 days.

(21) Appl. No.: 13/388,377

(22) PCT Filed: Sep. 22, 2010

(86) PCT No.: PCT/JP2010/005753

§ 371 (c)(1), (2), (4) Date: Apr. 4, 2012

(87) PCT Pub. No.: WO2011/039980

PCT Pub. Date: Apr. 7, 2011

(65) Prior Publication Data

US 2012/0180322 A1 Jul. 19, 2012

(30) Foreign Application Priority Data

Sep. 30, 2009 (JP) ..... 2009-229137
Sep. 30, 2009 (JP) ..... 2009-229139

(51) Int. Cl.
*F16N 7/00* (2006.01)
*F02F 7/00* (2006.01)
*F01M 1/02* (2006.01)

(52) U.S. Cl.
USPC ..... 123/195 C; 123/196 R; 184/106

(58) Field of Classification Search
USPC ..... 123/195 C, 196 R, 90.33, 90.39; 184/106
See application file for complete search history.

(56) References Cited

U.S. PATENT DOCUMENTS 4,519,348 A * 5/1985 Hamilton ..... 123/195 C
6,082,087 A * 7/2000 Tada et al. ..... 56/255

(Continued)

FOREIGN PATENT DOCUMENTS

CN 1348056 A 5/2002
CN 201176887 Y 1/2009

(Continued)

OTHER PUBLICATIONS

Japanese Office Action issued in Japanese Patent Application No. 2009-229139 dated Apr. 16, 2013, with English Translation.

(Continued)

*Primary Examiner* — Lindsay Low
*Assistant Examiner* — Tea Holbrook
(74) *Attorney, Agent, or Firm* — McDermott Will & Emery LLP

(57) ABSTRACT

There is provided a four-cycle engine which can appropriately circulate oil in an engine regardless of a tilted condition with a simple structure. A crankcase (4) of a four-cycle engine (1) has a crank room (41) which rotatably supports a crankshaft (10) and an oil room (42) which is provided adjacent to the exterior of the crank room (41). The crankcase (4) also has partition walls (43) and (44) which partition the interior of the crankcase (4) into the crank room (41) and the oil room (42), respectively, and a communication path (45) which communicates the crank room (41) with the oil room (42). The partition walls (43) and (44) each has a cross section formed in a substantially V shape, and the communication path (45) is formed at an apex between the partition walls (43) and (44).

6 Claims, 17 Drawing Sheets

(56) References Cited

U.S. PATENT DOCUMENTS

| | | | | |
|---|---|---|---|---|
| 6,119,648 | A * | 9/2000 | Araki | 123/196 R |
| 6,729,292 | B1 * | 5/2004 | Bock et al. | 123/195 C |
| 6,810,849 | B1 * | 11/2004 | Hirsch et al. | 123/185.3 |
| 6,889,651 | B2 * | 5/2005 | Tanaka et al. | 123/196 R |
| 7,134,418 | B2 * | 11/2006 | Nagel et al. | 123/196 R |
| 7,472,675 | B2 * | 1/2009 | Reustle | 123/196 R |
| 8,281,758 | B2 * | 10/2012 | Kurihara et al. | 123/90.33 |
| 2002/0020385 | A1 | 2/2002 | Stromsky et al. | |
| 2004/0255895 | A1 * | 12/2004 | Hirsch et al. | 123/196 R |
| 2005/0109307 | A1 * | 5/2005 | Kawamoto | 123/196 R |

FOREIGN PATENT DOCUMENTS

| | | | | |
|---|---|---|---|---|
| DE | 100 29 844 | A1 | 1/2002 | |
| EP | 0 962 630 | A2 | 12/1999 | |
| EP | 1749984 | A1 | 2/2007 | |
| JP | 62-66253 | | 4/1987 | |
| JP | 63-17850 | | 2/1988 | |
| JP | 10-317931 | | 12/1998 | |
| JP | 11-107736 | A | 4/1999 | |
| JP | 11-343822 | A | 12/1999 | |
| JP | 2001-336409 | A | 12/2001 | |
| JP | 3713125 | | 8/2005 | |
| JP | 2009-180193 | | 8/2009 | |
| JP | 2009180193 | * | 8/2009 | F01M 1/02 |

OTHER PUBLICATIONS

Japanese Office Action issued in Japanese Patent Application No. 2009-229137 dated Apr. 16, 2013, with English Translation.

Chinese Office Action, w/ English translation thereof, issued in Chinese Patent Application No. CN 201080021886.8 dated May 27, 2013.

* cited by examiner

FOUR-CYCLE ENGINE, BUSH CUTTER AND ENGINE-DRIVEN TOOL HAVING SAME

This application is the U.S. National Phase under 35 U.S.C. §371 of International Application No. PCT/JP2010/005753, filed on Sep. 22, 2010 which in turn claims the benefit of Japanese Application Nos. 2009-229137 filed on Sep. 30, 2009 and 2009-229139 filed on Sep. 30, 2009, the disclosures of which Applications are incorporated by reference herein.

TECHNICAL FIELD

The present invention relates to a four-cycle engine, and more particularly, a four-cycle engine suitable for portable engine-driven tools, such as a bush cutter, a chain saw, and a blower, and a bush cutter and an engine-driven tool each having the same.

BACKGROUND ART

According to portable engine-driven tools, such as a bush cutter and a chain saw, a worker often works while tilting such an engine-driven tool in various directions. Accordingly, it is requisite for an engine to stably operate even in the tilted condition. In particular, according to four-cycle engines, the interior of an engine is lubricated by supplying oil in an oil tank provided in the engine to individual parts of the engine. Consequently, it is necessary to supply the oil to the interior of the engine even if the engine is in a tilted condition. Accordingly, for example, a technology of Patent Literature 1 employs a structure which has an oil room in a crankcase separately from a crank room and which prevents the oil in the oil room from flowing back into the crank room.

CITATION LIST

Patent Literature

[PTL 1]
Japanese Patent No. 3713125

SUMMARY OF INVENTION

Technical Problem

Meanwhile, it is requisite for the engine of Patent Literature 1 to suppress any backflow of the oil from the oil room to the crank room and to return the oil from the oil room to the crank room. Accordingly, a one-way valve which opens when pressure in the crank room becomes higher than the pressure in the oil room is provided. Hence, the internal structure of the engine becomes complex, so that the number of components and the assembly man-hour increase, resulting in the increase of the production cost of the engine.

The present invention has been made in view of the foregoing problem, and it is an object of the present invention to provide a four-cycle engine which can supply oil to the interior of an engine regardless of a tilted condition to appropriately circulate the oil with a simple structure, and a bush cutter and an engine-driven tool each having the same.

Solution to Problem

To achieve the foregoing object, a four-cycle engine according to a first aspect of the present invention comprises:

a cylinder block which includes a cylinder bore retaining a piston moving back and forth;

a crankcase which is attached to the cylinder block and which rotatably supports a crankshaft;

a partition wall which partitions an interior of the crankcase into a crank room retaining the crankshaft and an oil room retaining an oil that lubricates the crankshaft;

a communication path which communicates the crank room with the oil room and which guides oil in the crank room to the oil room; and oil supply unit which supplies the oil in the oil room into the crank room, wherein when it is defined that a direction in which the piston goes from a bottomdead center toward a topdead center is up as viewed in an axial direction of the crankshaft, a cross section of the partition wall is formed in a substantially V shape with an apex being located downwardly, and the communication path is formed at the apex.

It is preferable that the communication path be located at a lower end of the crank room.

It is preferable that the communication path be located leftward of a plane which passes through an axial line of the crankshaft and includes an axial line of the cylinder bore as viewed from a direction in which the crankshaft rotates in a clockwise direction.

The partition wall may be formed of a first partition wall and a second partition wall which are spaced apart from each other at the apex, and the communication path may be defined by the first partition wall and the second partition wall.

It is preferable that the first partition wall be tilted so that an end at an apex side is located at a lowermost position.

It is preferable that the second partition wall be extended in the vertical direction.

It is preferable that the end of the first partition wall at the apex side be located leftward of an end of the second partition wall at the apex side as viewed from a direction in which the crankshaft rotates in a clockwise direction.

It is preferable that the oil room be defined by the partition wall and an external wall of the crankcase.

The oil room may include a first oil room which is defined by the lower wall of the partition wall and the external wall of the crankcase, and a second oil room which is defined by the other wall of the partition wall and the external wall of the crankcase.

A bush cutter equipped with the foregoing four-cycle engine according to a second aspect of the present invention is characterized in that an output shaft of the four-cycle engine for driving a reel of the bush cutter extends from the crankshaft in a direction in which a right-hand screw that rotates in the same direction as the crankshaft of the four-cycle engine rotates advances, and the reel of the bush cutter is configured to rotate in a counter-clockwise direction as the reel in a usage state is viewed from the above.

An engine-driven tool according to a third aspect of the present invention comprises the foregoing four-cycle engine.

Advantageous Effects of Invention

According to the present invention, it is possible to realize a four-cycle engine which can appropriately circulate oil in an engine regardless of a tilted condition with a simple structure at a low cost, and a bush cutter and an engine-driven tool each having the same.

A diagram showing a bush cutter equipped with a four-cycle engine according to the present invention.

[FIG. 2]

Figure 1:
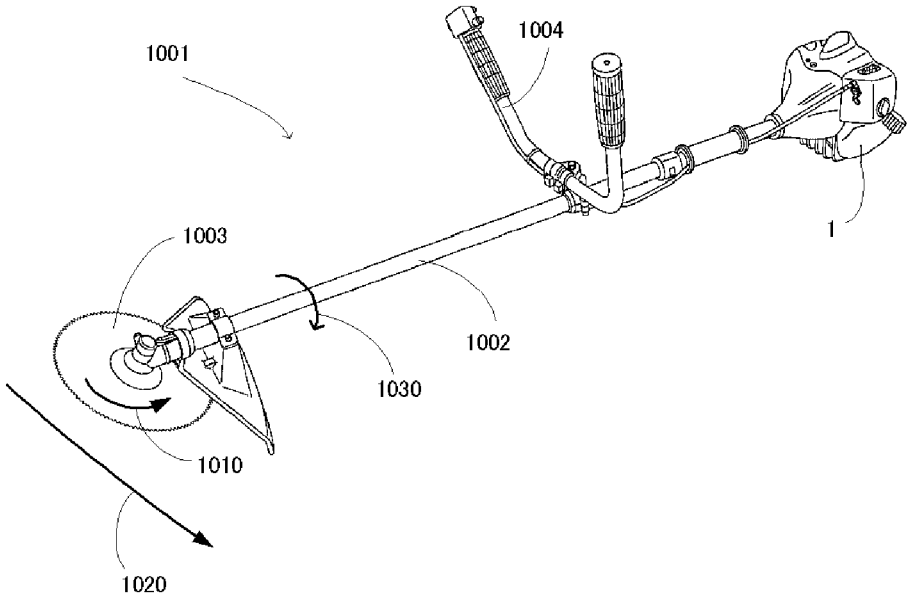
[FIG. 1]

A enlarged cross-sectional view showing an engine part in FIG. 1.

[FIG. 3]

Figure 2:
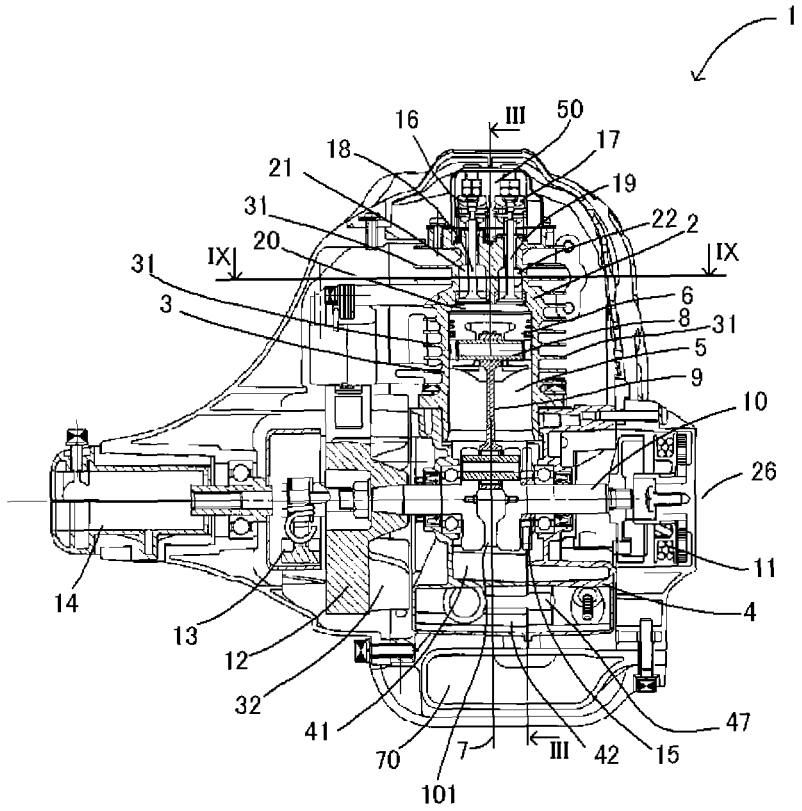

A cross-sectional view along a line III-III in FIG. 2.

[FIG. 4]

Figure 3:
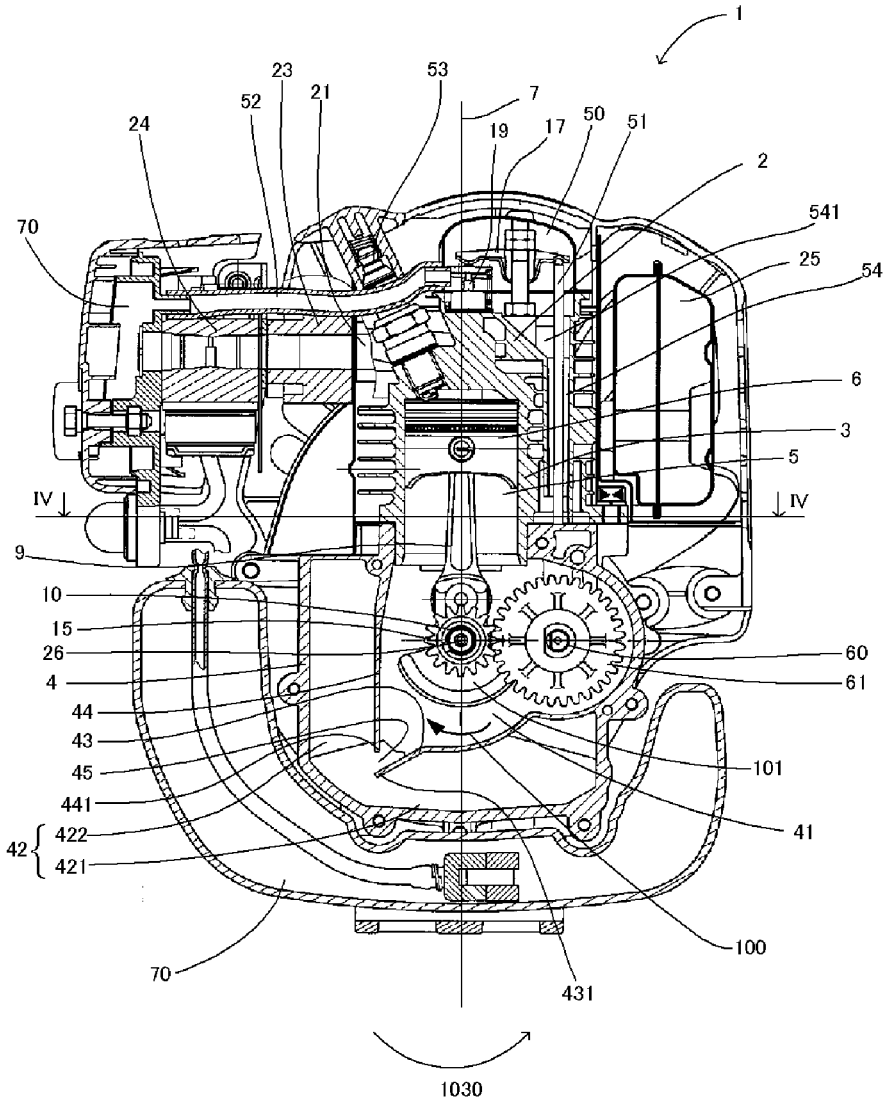

A cross-sectional view along a line IV-IV in FIG. 3.

[FIG. 5]

Figure 4:
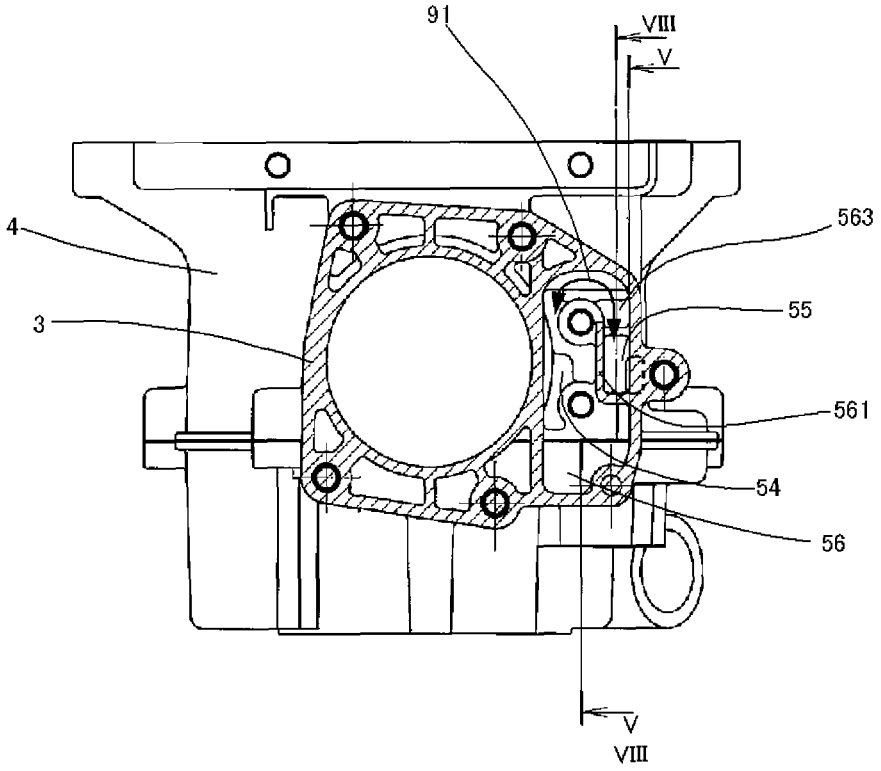

A cross-sectional view along a line V-V in FIG. 4.

[FIG. 6]

Figure 5:
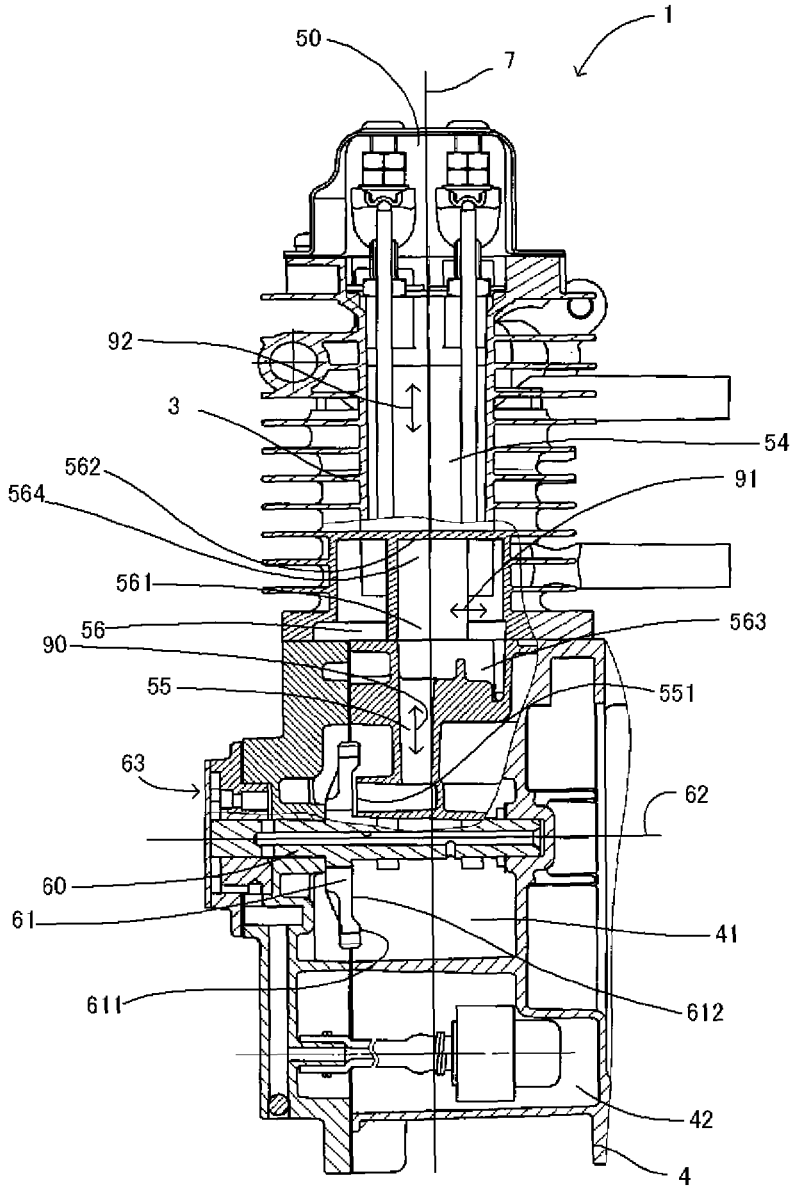

An enlarged cross-sectional view showing a crank room part in FIG. 5.

[FIG. 7]

Figure 6:
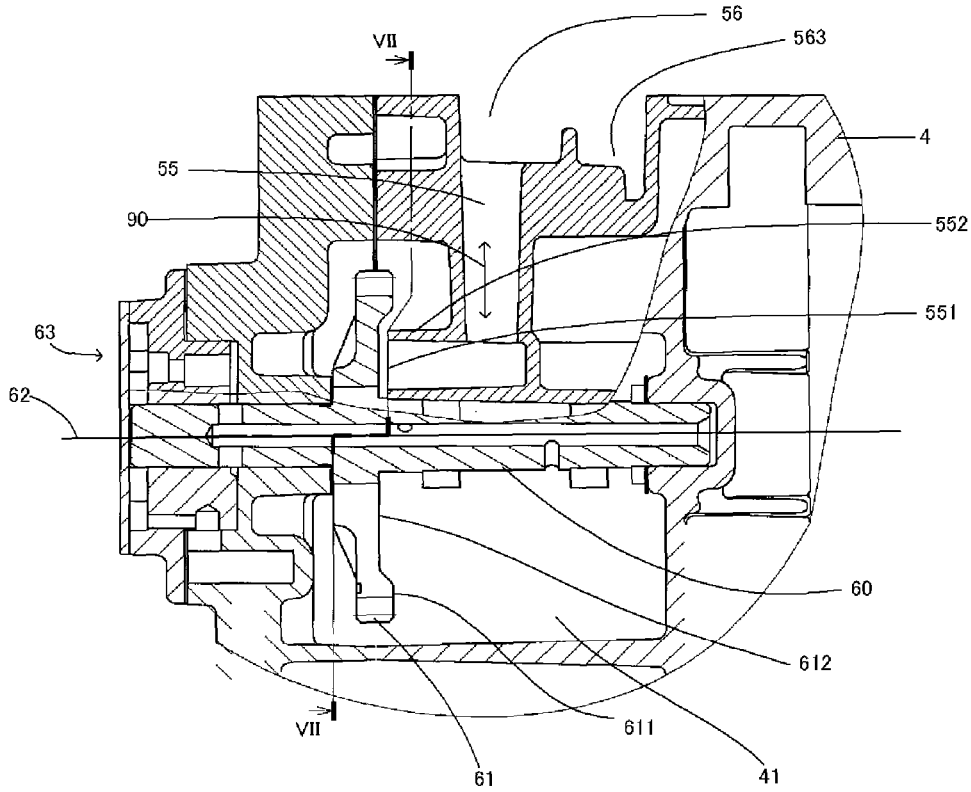

A cross-sectional view along a line VII-VII in FIG. 6.

[FIG. 8]

A cross-sectional view along a line VIII-VIII in FIG. 4.

[FIG. 9]

A cross-sectional view along a line IX-IX in FIG. 2.

[FIG. 10]

Figure 9:
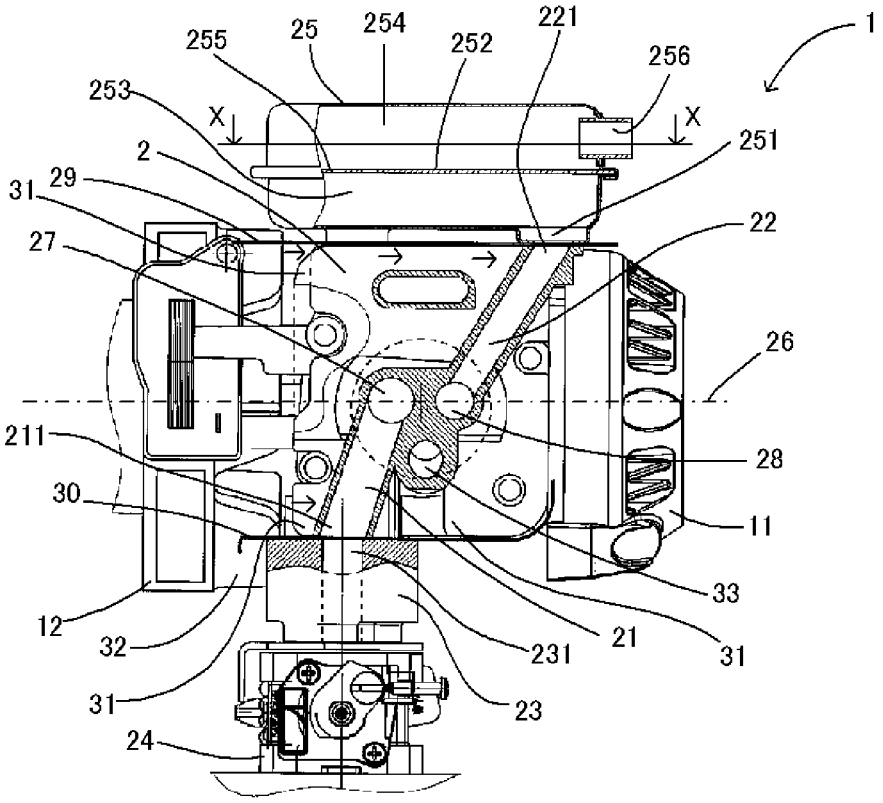

A cross-sectional view showing a muffler in FIG. 9 along a line X-X.

[FIG. 11]

An enlarged view showing a carburetor part in FIG. 9.

[FIG. 12]

An exploded view showing components between the engine and the carburetor.

[FIG. 13]

A front view showing the carburetor as viewed from the engine side.

[FIG. 14]

A front view showing a gasket of the present invention as viewed from the engine side.

[FIG. 15]

Figure 11:
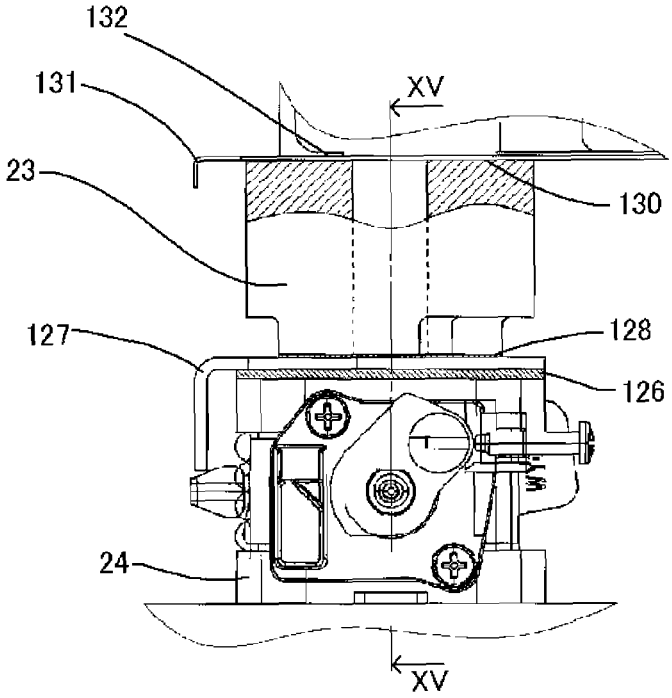

A cross-sectional view along a line XV-XV in FIG. 11.

[FIG. 16]

A diagram showing a modified example of an overhead-valve engine according to the present invention and corresponding to FIG. 6.

[FIG. 17]

Figure 15:
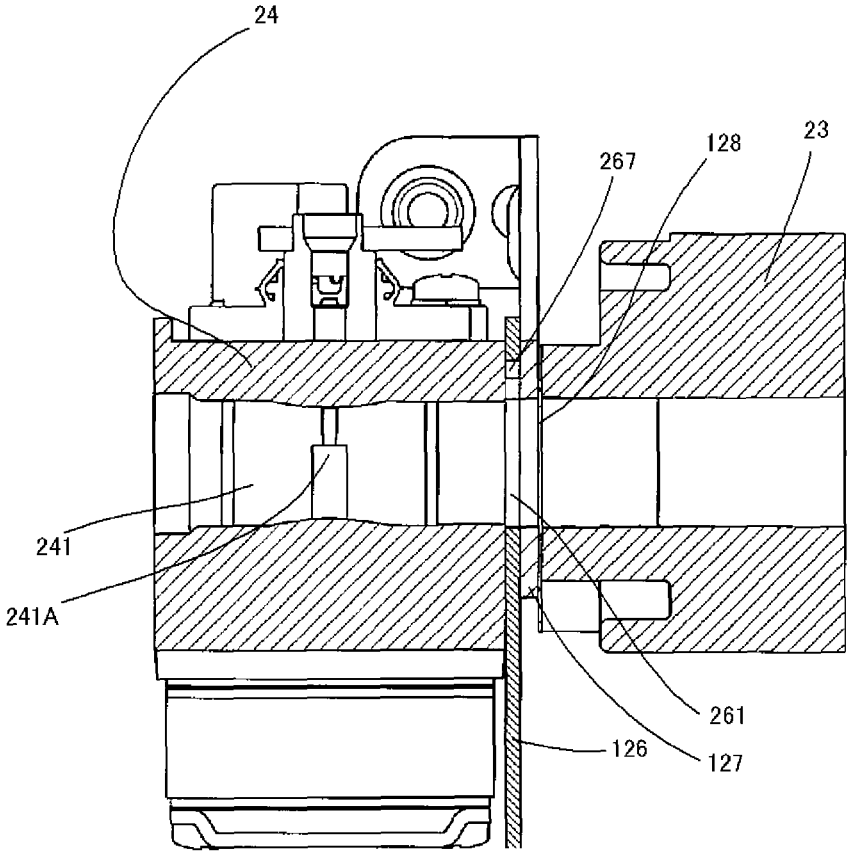

A diagram showing a modified example of a gasket according to the present invention and corresponding to FIG. 15.

DESCRIPTION OF EMBODIMENTS

An explanation will be given of an embodiment of the present invention along with the accompanying drawings. FIG. 1 shows a bush cutter 1001 equipped with a four-cycle engine 1 (hereinafter, an engine) according to one embodiment of the present invention. The bush cutter 1001 has a reel 1003 attached to the leading end of an operation rod 1002. The engine 1 is attached to the rear end of the operation rod 1002. An output by the engine 1 is supplied to the reel 1003 through a drive shaft inserted in the operation rod 1002. A worker grasps a handle 1004 attached to the operation rod 1002 to manipulate the bush cutter 1001. In a normal upright state (a state in which the worker grasps the bush cutter 1001), the engine 1 is attached to the operation rod 1002 so that the axial-line direction of a cylinder (not illustrated) is directed to the vertical direction. Moreover, as is indicated by an arrow 1010, the reel 1003 in operation is configured to rotate in a counterclockwise direction as viewed from the above. The worker grasps the bush cutter 1001 so that the operation rod 1002 is located at the right of the body of the worker. As is indicated by an arrow 1020, the worker moves the reel 1003 to the left and cuts branches, grasses, etc. growing on a ground.

As shown in FIG. 2, the engine 1 is an air-cooled OHV engine. A cylinder head 2 is formed on the top part of a cylinder block 3 so as to be joined together. A crankcase 4 is attached at the bottom part of the cylinder block 3. Cooling fins 31 for cooling the engine 1 are formed around the cylinder block 3. In a cylinder (cylinder bore) 5 of the cylinder block 3, a piston 6 located at a topdead center in FIG. 2 moves up and down in the direction of a cylinder axial line 7 (in the vertical direction in FIG. 2). The piston 6 is connected to a crankshaft 10 via a piston pin 8 and a connecting rod 9. The crankshaft 10 has a crank weight 101 rotatably supported in a crank room 41 of the crankcase 4. The interior of the crankcase 4 is segmented into the crank room 41 and an oil room 42. The oil room 42 is provided adjacent to the bottom part of the crank room 41. Moreover, the oil room 42 is provided with an oil inlet 47. The oil inlet 47 is connected to an oil pump (not illustrated). The oil pump suctions oil accumulated in the oil room 42 through the oil inlet 47. Thereafter, the oil pump delivers the oil into the crank room 41 from an oil discharging hole (not illustrated) formed in a camshaft (not illustrated). The delivered oil becomes oil mists and splashed in the crank room.

A starter mechanism 11 for starting the engine 1 is attached to one end part of the crankshaft 10. A flywheel magnet 12 is attached to the other end part of the crankshaft 10. A cooling fan 32 for cooling the engine 1 is formed integrally with the flywheel magnet 12. Moreover, a clutch mechanism 13 is connected to the flywheel magnet 12. The clutch mechanism 13 transmits an output by the engine 1 to a drive shaft (an output shaft) 14 to drive the reel 1003. Furthermore, a cam drive gear 15 for driving the camshaft (not illustrated) is attached to the crankshaft 10.

Formed in the cylinder head 2 are an intake port 21 which supplies an air-fuel mixture into a combustion chamber 20 and an exhaust port 22 which exhausts a combustion gas from the combustion chamber 20. The intake port 21 is opened/closed by an intake valve 18, and the exhaust port 22 is opened/closed by an exhaust valve 19. Moreover, a valve mechanism room 50 is provided on the cylinder head 2. The valve mechanism room 50 retains an intake rocker arm 16 and an exhaust rocker arm 17 which open/close the intake valve 18 and the exhaust valve 19, respectively.

As shown in FIG. 3, a carburetor 24 is attached to the left side of the cylinder head 2 via an insulator 23 connected to the intake port 21. The carburetor 24 supplies an air-fuel mixture into the engine 1 through the insulator 23. An air cleaner 70 is attached at the upper stream side (left in FIG. 3) of the carburetor 24. A connection path 52 is provided between the air cleaner 70 and the valve mechanism room 50. The connection path 52 causes a blow-by gas flowing in the valve mechanism room 50 to flow into the air cleaner 70. Moreover, a muffler 25 is attached to the right side of the cylinder head 2. The muffler 25 is connected to the exhaust port 22. Furthermore, a spark plug 53 is attached to the cylinder head 2.

A camshaft 60 is provided in the crank room 41 of the crankcase 4. The camshaft 60 has a driven gear 61 which meshes with the cam drive gear 15 of the crankshaft 10. An intake cam (not illustrated) and an exhaust cam (not illustrated) are formed at the camshaft 60. The intake cam and the exhaust cam drive an intake pushrod (not illustrated) and an exhaust pushrod 51, respectively, via tappets (not illustrated). The intake pushrod and the exhaust pushrod 51 respectively drive the intake rocker arm 16 and the exhaust rocker arm 17 both provided in the valve mechanism room 50. The intake rocker arm 16 and the exhaust rocker arm 17 respectively open/close the intake valve 18 and the exhaust valve 19, respectively.

As shown in FIG. 3, the crank room 41 of the crankcase 4 and the oil room 42 thereof are partitioned by a partition wall. The partition wall has a horizontal partition wall (a first partition wall) 43 extending in the horizontal direction and a vertical partition wall (a second partition wall) 44 extending in the vertical direction. In FIG. 3, the vertical partition wall 44 is located at the left of the crankshaft 10. The vertical partition wall 44 extends downwardly from the upper-left internal wall of the crankcase 4 over an axial line 26 of the crankshaft 10. Moreover, the horizontal partition wall 43 is located below the crankshaft 10. The horizontal partition wall 43 extends leftward from the lower-right internal wall of the crankcase 4 over the axial line 26 of the crankshaft 10. In the horizontal direction in FIG. 3, a left end 431 of the horizontal partition wall 43 is located below a lower end 441 of the horizontal partition wall 44, or located at the leftward from the lower end 441. Furthermore, the horizontal partition wall 43 gradually goes downwardly from a horizontal plane toward the left. The left end 431 is located at the lowermost position. The lower end 441 of the vertical partition wall 44 and the left end 431 of the horizontal partition wall 43 are spaced apart from each other. Formed by this space is a communication path 45 which communicates the crank room 41 with the oil room 42. As shown in FIG. 3, the vertical partition wall 44 and the horizontal partition wall 43 each has a cross section formed in a substantially V shape. The apex of the substantially V shape is located at the lower left of the crankshaft 10. The communication path 45 is formed at the apex of the substantially V shape. Moreover, the oil room 42 has a first oil room 421 and a second oil room 422. The first oil room 421 is defined by the horizontal partition wall 43 and the external wall of the crankcase 4. The second oil room 422 is defined by the vertical partition wall 44 and the external wall of the crankcase 4.

A first breather path (a second path) 54 is provided in the cylinder block 3. The first breather path 54 runs from the valve mechanism room 50 along the direction of the cylinder axial line 7 toward the crankcase 4. Moreover, the first breather path 54 has a valve-mechanism-room-side opening 541. The valve-mechanism-room-side opening 541 is provided in the valve mechanism room 50. The intake pushrod and the exhaust pushrod 51 pass all the way through the first breather path 54. As shown in FIG. 4, the first breather path 54 is connected to a second breather path (a first path) 55 via a third breather path (a third path) 56. The second breather path 55 is communicated with the crank room 41 of the crankcase 4. The third breather path 56 is formed at a connection part between the cylinder block 3 and the crankcase 4. Note that the first breather path 54 and the second breather path 55 are arranged so as to have respective opening positions in the third breather path 56 offset from each other as viewed in the direction of the cylinder axial line 7. Moreover, a partition wall 561 is provided in the third breather path 56. As viewed in the direction of the cylinder axial line 7, the partition wall 561 extends in the direction of the cylinder axial line 7, and surrounds the periphery of the second breather path 55 without the upper part thereof in FIG. 4. Furthermore, as shown in FIG. 5, the third breather path 56 has a cylinder-side recess 564 which concaves toward the top. A ceiling wall 562 is provided above the second breather path 55 in the direction of the cylinder axial line 7. Moreover, a concaved part (a recess) 563 is formed at the crankcase 4 side of the third breather path 56. As shown in FIG. 4, as viewed in the direction of the cylinder axial line 7, the concaved part 563 is arranged so as to overlap with a part of the first breather path 54.

As shown in FIG. 5, the second breather path 55 runs from the third breather path 56 along the direction of the cylinder axial line 7 toward the crank room 41. The second breather path 55 is communicated with the crank room 41 through a crank-room-side opening 551. The crank-room-side opening 551 is provided so as to be opposite to a right rotational plane 661 of the driven gear 61 of the camshaft 60 in the crank room 41.

Figure 7:
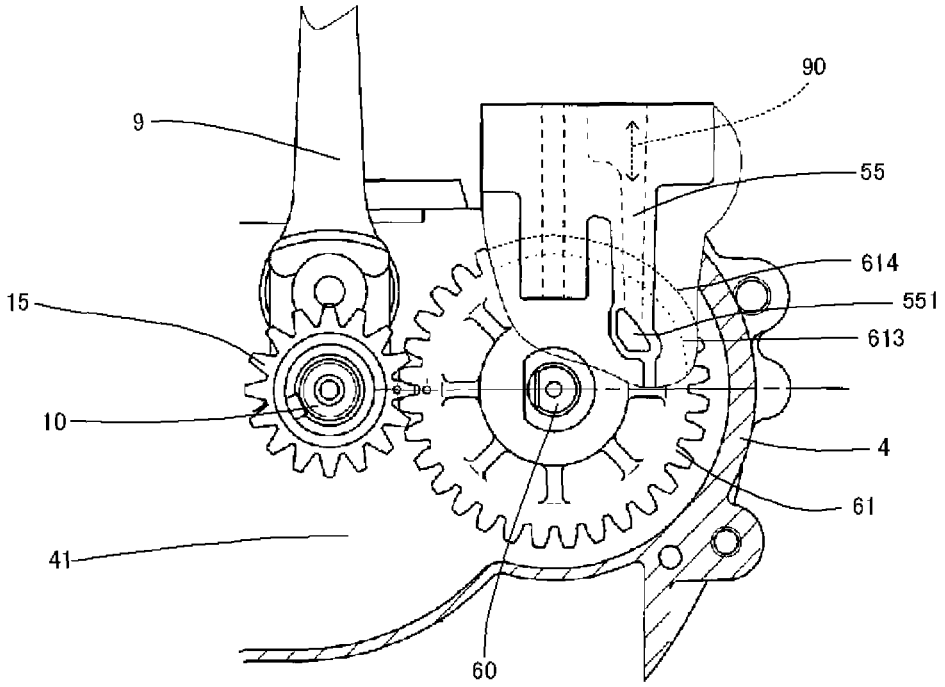

As shown in FIG. 6, an annular recess 612 is formed at the rotational plane 611 of the driven gear 61. Moreover, the crank-room-side opening 551 is formed in the left end of a tubular protrusion wall 552 in FIG. 5 and in FIG. 6. The protrusion wall 552 protrudes toward the recess 612 of the driven gear 61. The crank-room-side opening 551 is located inwardly of the recess 612 in the direction of an axial line 62 of the camshaft 60. That is, the left end of the protrusion wall 552 forming the crank-room-side opening 551 is located leftward of a rightmost side face of the rotational plane 611 of the driven gear 61. As shown in FIG. 7, as viewed in the direction of the axial line 62 of the camshaft 60, the annular recess 612 is located inwardly of a root circle 613 of the driven gear 61, and the crank-room-side opening 551 is located inwardly of the recess 612.

Figure 8:
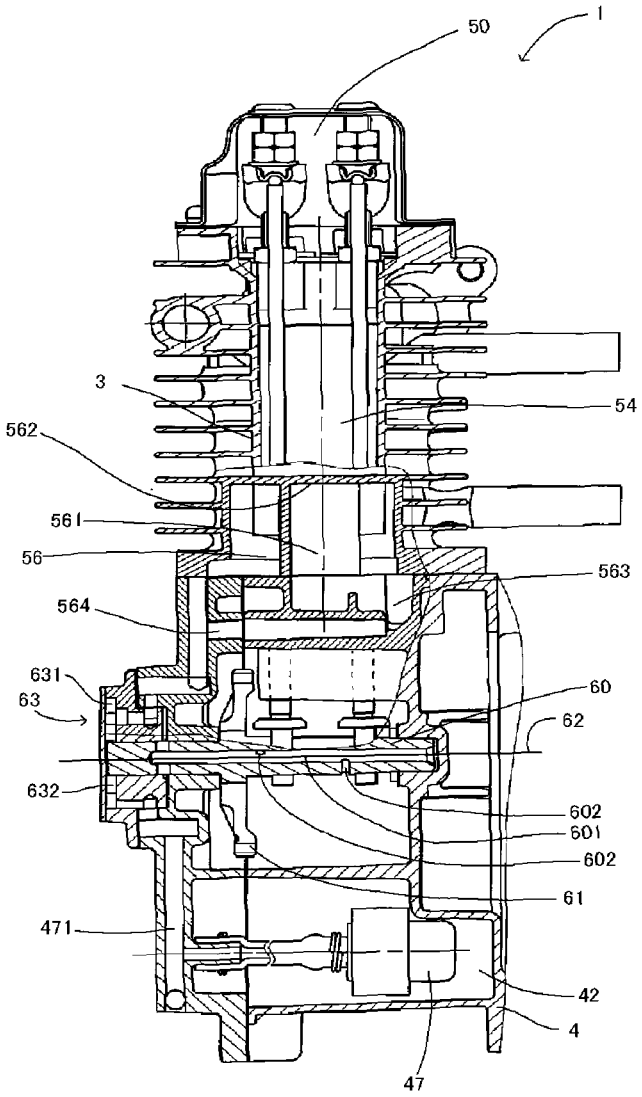

As shown in FIG. 8, an oil pump 63 is connected to the left end of the camshaft 60. The oil pump 63 is a trochoid pump, and has an outer rotor 631 and an inner rotor 632. The oil inlet 47 of the oil room 42 is connected to the inlet (not illustrated) of the oil pump 63 through an oil intake path 471. Moreover, the concaved part 563 of the third breather path 56 is connected to the inlet of the oil pump 63 through an oil return path 564 (a fourth path). Furthermore, the delivery opening of the oil pump 63 is formed in the interior of the camshaft 60, and is connected to an oil supply path 601 running in the direction of the axial line 62 of the camshaft 60. The oil supply path 601 is connected to multiple oil delivery openings 602 formed in the outer circumference face of the camshaft 60, and reaches the interior of the crank room 41. The oil pump 63 suctions oils accumulated in the oil room 42 and in the concaved part 563 of the third breather path 56 while the engine 1 is rotating, and delivers the oils into the crank room 41 through the oil delivery openings 602 of the rotating camshaft 60. Some of the delivered oils become oil mists and splashed in the crank room 41.

As shown in FIG. 9, as viewed in the direction of the cylinder axial line 7, the cylinder head 2 has an outer circumference formed in a substantially rectangular shape. Moreover, the cylinder head 2 has an opening 27 (a combustion-chamber-side intake opening) provided at the combustion chamber 20 side of the intake port 21, and an opening 28 (a combustion-chamber-side exhaust opening) provided at the combustion chamber 20 side of the exhaust port 22. As viewed in the direction of the cylinder axial line 7, the combustion-chamber-side intake opening 27 and the combustion-chamber-side exhaust opening 28 are arranged side by side and substantially parallel to the axial line 26 of the crankshaft 10. Moreover, the combustion-chamber-side intake opening 27 is arranged so as to be located at the flywheel-magnet 12 side. Likewise, the intake valve 18 and the exhaust valve 19 which respectively open/close the combustion-chamber-side intake opening 27 and the combustion-chamber-side exhaust opening 28 are arranged side by side and substantially parallel to the axial line 26 of the crankshaft 10. The muffler 25 is attached to the upper side face (one side) of the cylinder head 2 in FIG. 9 substantially parallel to the axial line 26 of the crankshaft 10 via a baffle plate 29. Likewise, the carburetor 24 is attached to the lower side face (the other side) via a baffle plate 30 and the insulator 23.

As shown in FIG. 9, as viewed in the direction of the cylinder axial line 7, the intake port 21 runs from the combustion-chamber-side intake opening 27 toward a first direction (a direction apart from the axial line 26 of the crankshaft 10, and is the direction toward the lower side face where the carburetor 24 is attached via the insulator 23) so as to come close to the outer circumference face (a first side) of the cylinder head 2 facing the flywheel magnet 12. That is, the intake port 21 runs obliquely downward left in FIG. 9. An intake-side opening 211 is opened in the lower side face of the cylinder head 2 in FIG. 9. The intake port 21 is connected to the insulator 23 through the intake-side opening 211. The carburetor 24 is connected to the insulator 23. An air-fuel mixture is supplied from the carburetor 24 into the intake port 21 through a communication hole 231 of the insulator 23.

Moreover, as shown in FIG. 9, as viewed in the direction of the cylinder axial line 7, the exhaust port 22 runs from the combustion-chamber-side exhaust opening 28 toward a second direction (a direction apart from the axial line 26 of the crankshaft 10, and is a direction toward the muffler 25) so that a distance from the combustion-chamber-side exhaust opening 28 in the direction of the axial line 26 of the crankshaft 10 increases as becoming apart from the combustion-chamber-side exhaust opening 28 (so as to be apart from the outer circumference face of the cylinder head 2 facing the flywheel magnet 12). That is, the exhaust port 22 runs obliquely upward right in FIG. 9. An exhaust-side opening 221 is opened in the end of the upper side face of the cylinder head 2 at a side apart from the flywheel magnet 12. The exhaust port 22 is connected to the muffler 25 through the exhaust-side opening 221.

Figure 10:
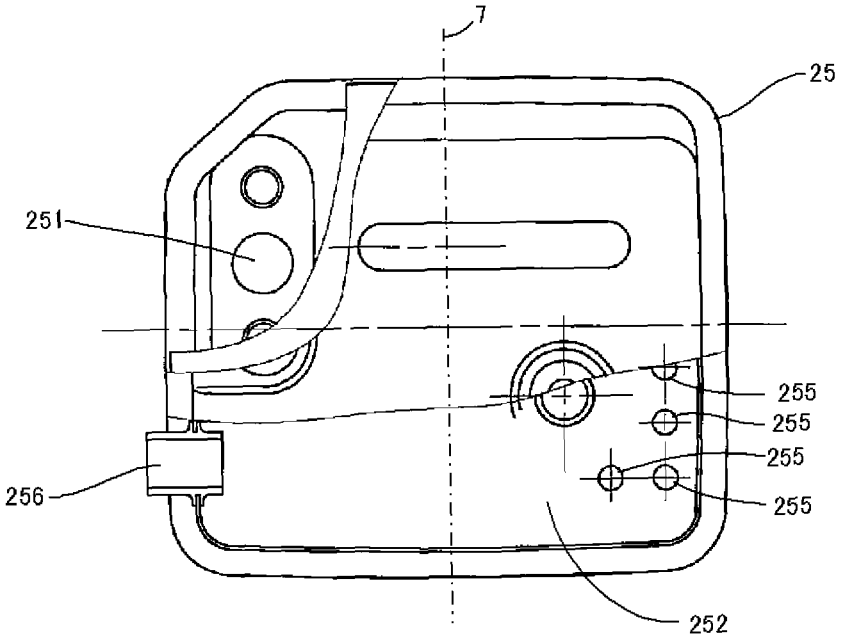

The muffler 25 is formed in a substantially flat rectangular solid shape. The face of the muffler 25 having the largest area is arranged at a position facing the upper side face of the cylinder head 2 where the exhaust-side opening 221 is provided. As shown in FIG. 10, an exhaust inflow opening 251 is provided in the vicinity of the upper left end of a face of the muffler 25 facing the cylinder head 2. The exhaust inflow opening 251 corresponds to the position of the exhaust-side opening 221 of the cylinder head 2. The exhaust inflow opening 251 is connected to the exhaust-side opening 221 across a non-illustrated gasket and the baffle plate 29. As shown in FIG. 9, the interior of the muffler 25 is divided into a first room 253 and a second room 254 with a partition wall 252. The partition wall 252 is provided substantially parallel to the face facing the cylinder head 2. Multiple connecting paths 255 connecting the first room 253 and the second room 254 together are provided in the partition wall 252. As shown in FIG. 10, the connecting path 255 is provided in the vicinity of the lower right end of the partition wall 252 so that a distance from the exhaust inflow opening 251 becomes large. An exhaust outflow opening 256 communicated with the exterior is provided in the second room 254. As shown in FIG. 9, the exhaust outflow opening 256 adjoins the face of the muffler 25 facing the cylinder head 2, and is provided in a side face at the exhaust inflow opening 251 side running in the direction of the cylinder axial line 7. That is, the exhaust stream outlet 256 is provided in the right side face of the muffler 25 in FIG. 9. As shown in FIG. 10, in the direction of the cylinder axial line 7, the exhaust outflow opening 256 is provided at a substantially same position as that of the connecting path 255 and in the vicinity of the lower end of the side face.

As shown in FIG. 9, a spark plug mounting hole 33 to mount a non-illustrated spark plug is formed in the cylinder head 2. The spark plug mounting hole 33 is formed between the combustion-chamber-side intake opening 27 and the combustion-chamber-side exhaust opening 28 in the direction of the axial line 26 of the crankshaft 10. Moreover, the spark plug mounting hole 33 is formed at the carburetor 24 side relative to the combustion-chamber-side intake opening 27 or to the combustion-chamber-side exhaust opening 28 at a right angle to the axial line 26 of the crankshaft 10. That is, the spark plug mounting hole 33 is formed at the right of the intake port 22 in FIG. 9.

Figure 12:
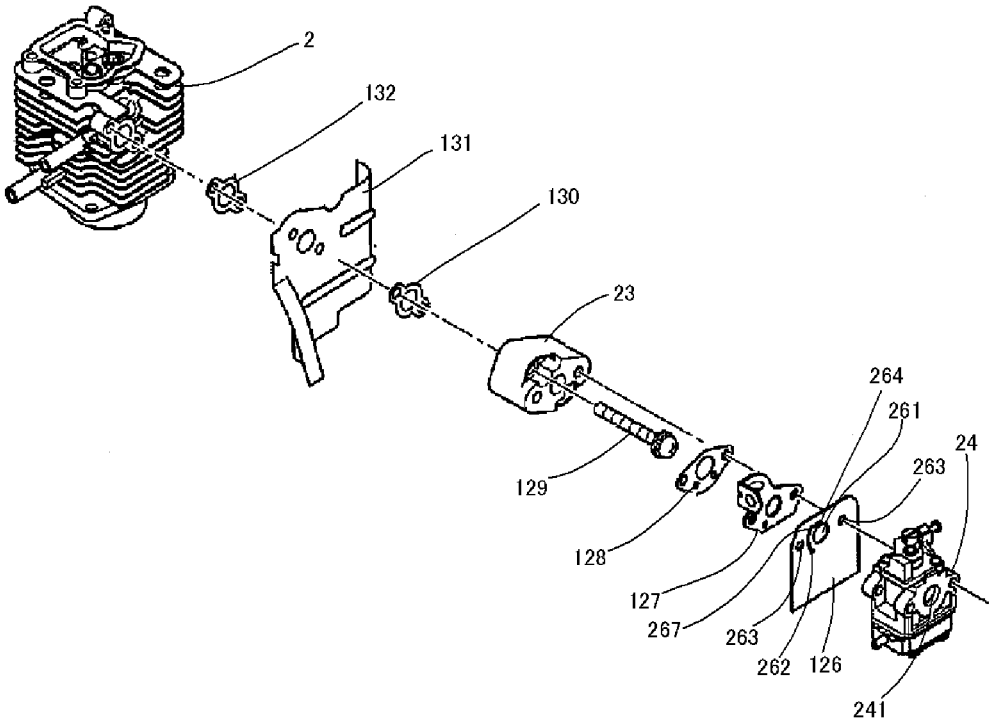

As shown in FIG. 11 and FIG. 12, provided between the carburetor 24 and the cylinder head 2 are a first gasket 126 (a diaphragm-type carburetor gasket), a wire guide 127, a second gasket 128, the insulator 23, a third gasket 130, a baffle plate 131, and a fourth gasket 132 in this order from the carburetor 24 side. The material of the first gasket 126 is a non-asbestos sheet having a thickness of approximately 0.8 mm. Moreover, respective materials of the second gasket 128, of the third gasket 130, and of the fourth gasket 132 are all non-asbestos sheets like the first gasket 126. However, the second gasket 128, the third gasket 130, and the fourth gasket 132 all have a thickness of 0.3 mm, and are thinner than the first gasket 126. Note that the individual gaskets are not limited to the non-asbestos sheet, and can be a metal gasket.

The insulator 23 is attached to the cylinder head 2 together with the third gasket 130, with the baffle plate 131, and with the fourth gasket 132 by means of a fixing screw 129. Moreover, the carburetor 24 is attached to the insulator 23 together with the first gasket 126, with the wire guide 127, and with the second gasket 128 by means of a non-illustrated fixing screw.

Figure 13:
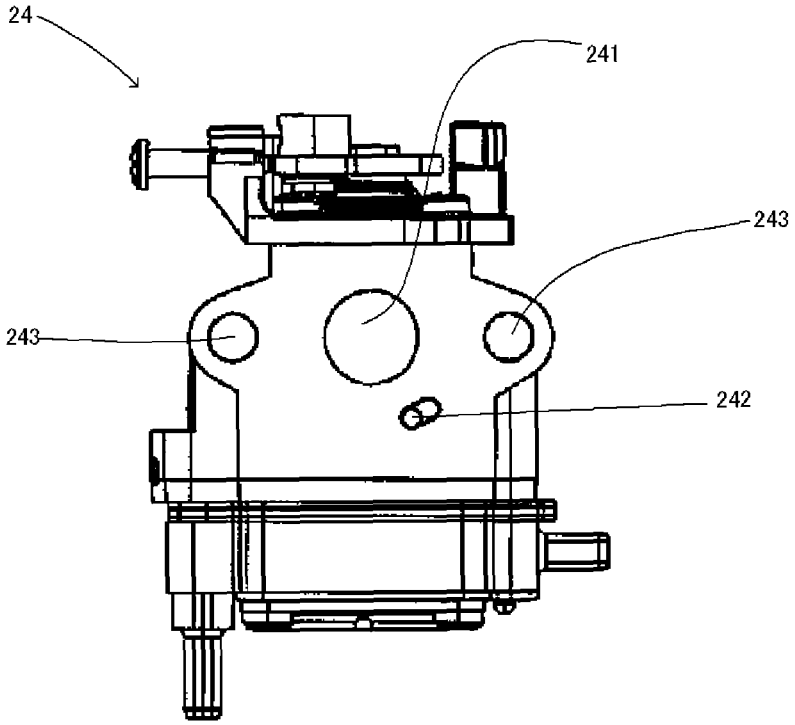

As shown in FIG. 13, an intake path 241 with a substantially circular cross section where an air-fuel mixture flows is formed in a plane of the carburetor 24 where the first gasket 126 is attached. Moreover, a pulse hole 242 is formed in the plane of the carburetor 24 where the first gasket 126 is attached. The pulse hole 242 transmits a pressure fluctuation to a diaphragm (not illustrated) in order to actuate the diaphragm. The diaphragm is located at the obliquely lower right of the intake path 241 in FIG. 13, and supplies fuel to the carburetor 24. Moreover, a mounting hole 243 is also formed in the plane of the carburetor 24 where the first gasket 126 is attached. The fixing screw which attaches the carburetor 24 to the insulator 23 passes all the way through the mounting hole 243. In a condition in which the carburetor 24 is attached to the engine 1, the pulse hole 242 is located below the intake path 241 with a direction from a bottomdead center of the cylinder axial line direction toward a topdead center thereof being up.

Figure 14:
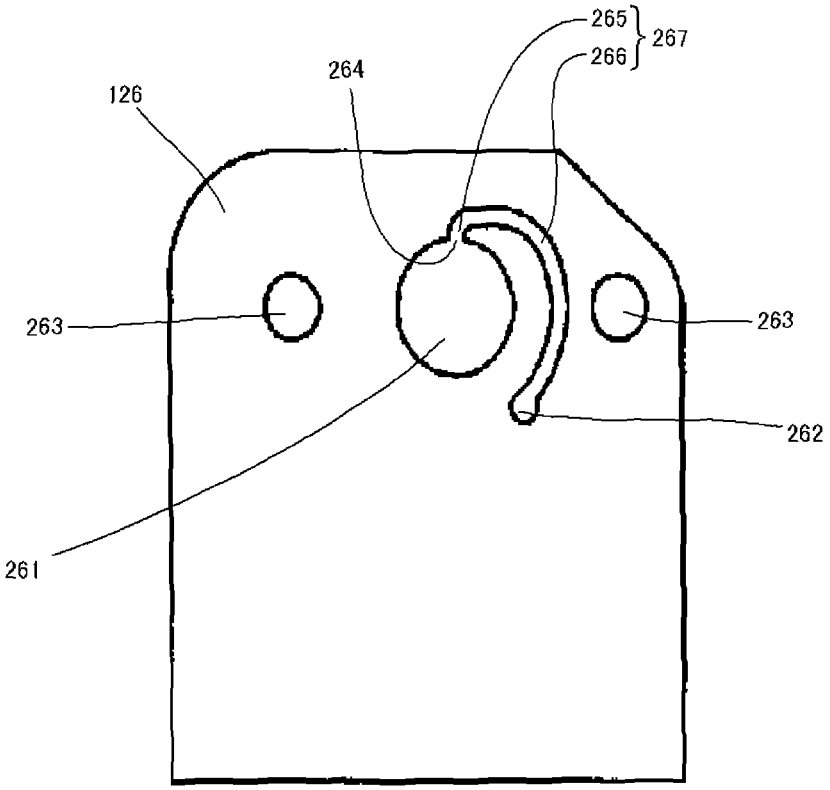

Moreover, as shown in FIG. 14, formed in the first gasket 126 which is attached to the carburetor 24 are an intake path opening 261 with a substantially circular cross section where an air-fuel mixture flows, a mounting hole 263, and a pulse-pressure communication path 267. The intake path opening 261 is provided at a position which corresponds to the intake path 241 of the carburetor 24 at the time of attachment. The pulse pressure communication path 267 has a first connection 264 connected to the intake path opening 261, ends at a pulse communication hole (a second connection) 262, and connects the intake path opening 261 and the pulse communication hole 262 together. The pulse communication hole 262 is provided at a position which corresponds to the pulse hole 242 of the carburetor 24 at the time of attachment. The first connection 264 of the pulse pressure communication path 267 is connected to the upper side of the intake communication opening 261 in FIG. 14, and more particularly, to the top end thereof. The pulse pressure communication path 267 has an extending part 265 and a direction changing part 266. The extending part 265 runs from the first connection 264 outwardly of the radial direction of the intake path opening 261. The direction changing part 266 is connected to the extending part 265, and bends the extending direction of the pulse pressure communication path 267 running upwardly in FIG. 14 toward the lower right direction. Note that as shown in FIG. 14 and FIG. 15, the intake path opening 261 of the first gasket 126, the mounting hole 263, the pulse communication hole 262, and the pulse pressure communication path 267 are all formed so as to pass all the way through the first gasket 126 in the thickness direction. The direction changing part 266 is coupled to the pulse communication hole 262 while maintaining a predetermined distance from the intake path 241, thereby maintaining an insulation property against the intake path 241. As shown in FIG. 15, a fuel supply part 241A for supplying fuel from a fuel tank 70 into the intake path 241 is located at the intake path 24. Accordingly, the fuel supplied into the intake path 241 becomes rich at the lower part of the intake path 241 where the fuel supply part 241A is located and becomes thin at the upper side. Moreover, the first connection 264 of the pulse pressure communication path 267 is located opposite to the fuel supply part 241A in the radial direction of the intake path 241, so that the first connection 264 is less likely to be clogged with the fuel.

According to the engine 1 employing the foregoing configuration, while the engine 1 is operating with the bush cutter 1001 being in an upright state, oils adhering to the crankshaft 10 and to the crank weight 101 in oils (oil mists) splashed in the crank room 41 by the oil pump are splashed in the radial direction by centrifugal force generated by the rotation of the crankshaft 10. Oils splashed upwardly in FIG. 3 are supplied into the cylinder 5 and to the piston 6. Conversely, as is indicated by an arrow 100, the engine 1 rotates in a clockwise direction. Moreover, the vertical partition wall 44 is located at the left of the crankshaft 10 to which oils splashed in the horizontal direction from the crankshaft 10 are likely to adhere. Accordingly, oils splashed to the left in FIG. 3 adhere to the vertical partition wall 44, and then falls downwardly by gravity along the vertical partition wall 44. Furthermore, oils splashed downwardly and oils falling down by gravity are to adhere to the horizontal partition wall 43. As the horizontal partition wall 43 is tilted toward the lower left direction, the oils adhered to the horizontal partition wall 43 move toward the lower left left-end 431. The oils which has moved along the vertical partition wall 44 and along the horizontal partition wall 43 reach the communication path 45, and return from the communication path 45 to the oil room 42. Accordingly, it becomes possible for the engine 1 to promptly return excessive oils from the crank room 41 to the oil room 42, thereby preventing the crank weight 101 from scooping the oils. Moreover, it becomes possible for the engine 1 to prevent excessive oils from remaining in the crank room 41 and to appropriately circulate the oils in the engine 1. Consequently, it becomes also possible for the engine 1 to suppress any excessive supply of the oil mists into the valve mechanism room 50 inherent to excessive oil remaining in the crank room 41. The oil mists excessively supplied into the valve mechanism room 50 are prevented from returning together with a blow-by gas from the connection path 52 to the air cleaner 70. As a result, it becomes possible for the engine 1 to prevent the oils from adhering to the air cleaner 70 and from becoming intake resistances. Moreover, it becomes possible for the engine 1 to suppress any increase of oil consumption originating from oil burning, carbon build-up in the combustion chamber, and deterioration of the value of exhaust gas characteristic. Furthermore, because of a simple structure having the horizontal partition wall 43 and the vertical partition wall 44 in the crankcase 4, the foregoing effect can be accomplished while the production cost of the engine 1 is held down.

Moreover, even in a case in which the engine 1 is tilted from an upright state in FIG. 3 and rotated in a clockwise direction by, for example, up to approximately 90 degree while the bush cutter 1001 is in operation, the oils in the oil room 42 can be accumulated in the first oil room 421 by the vertical partition wall 43. Furthermore, even in a case in which the engine 1 is rotated in a counterclockwise direction by, for example, up to approximately 90 degree in FIG. 3, the oils in the oil room 42 can be accumulated in the second oil room 421 by the vertical partition wall 44. Accordingly, the oils in the oil room 42 can be always accumulated in the oil room 42 and any backflow of the oils in the oil room 42 into the crank room 41 can be suppressed within an expected range of tilting of the engine 1 while the bush cutter 1001 is in operation by a simple technique of just providing the horizontal partition wall 43 and the vertical partition wall 44 in the crankcase 4 with the production cost being held down. This enables the appropriate circulation of the oils within the engine 1. Moreover, any excessive supply of oil mists into the valve mechanism room 50 can be suppressed, thereby preventing the oils from adhering to the air cleaner 70 and from becoming the intake resistances. Furthermore, it becomes possible for the engine 1 to suppress any increase of oil consumption originating from oil burning, carbon built-up in the combustion chamber, and deterioration of the value of exhaust gas characteristic.

Moreover, as shown in FIG. 1, according to the bush cutter 1001 having the reel 1003 which rotates in a counterclockwise direction as viewed from the above, a worker often slightly tilts the bush cutter 1001 in a direction indicated by an arrow 1030 in FIG. 1 and FIG. 3, makes the reel 1003 horizontal to a ground, moves close the left end of the bush cutter 1001 to the ground and works so as not to leave the left end of a cutting target. In the bush cutter 1001, the drive shaft 14 of the engine 1 extends in a direction in which a right-hand screw which rotates in the same direction as that of the crankshaft 10 at the time of the positive rotation of the engine 1 advances from the crankshaft 10, i.e., as shown in FIG. 3, to the left in FIG. 2 from the engine 1 rotating in the clockwise direction. Accordingly, as shown in FIG. 3, according to the engine 1 tilted in the direction of the arrow 1030, the angle of tilt of the horizontal partition wall 43 becomes close to vertical. Accordingly, the vertical partition wall 44 also keeps maintaining an angle close to a vertical direction. The communication path 45 is located at the lowermost part of the horizontal partition wall 43 and that of the vertical partition wall 44 in the vertical direction. Accordingly, oils adhered to the vertical partition wall 44 and to the horizontal partition wall 43 both in the crank room 42 can be more promptly returned to the oil room 42 through the communication path 45. This enables oil circulation in the engine 1 more appropriately. Consequently, in many postures of the engine 1, excessive oils are prevented from remaining in the crank room 41, so that the same effect as the foregoing effect can be acquired more efficiently.

Note that in the foregoing embodiment, the communication path 45 is formed as the respective ends of the horizontal partition wall 43 and of the vertical partition wall 44 are spaced apart from each other. However, the configuration of the communication path 45 is not limited to such configuration. For example, the left side end 431 of the horizontal partition wall 43 and the lower end of the vertical partition wall 44 may be joined together, and one or multiple openings may be formed in the joined part to form a communication path. Moreover, as shown in FIG. 3, the cross section of the horizontal partition wall 43 has a part which is curved coaxially with the crankshaft 10 below the crankshaft 10. However, as far as the cross section has a shape which allows oils to flow toward the communication path 45 along the horizontal partition wall 43 in many conditions in which the engine 1 is slightly tilted in particular, the cross section may be formed flat, or may be formed so as to have another partial curved face.

Moreover, according to the engine 1 employing the foregoing configuration, oil mists which are delivered through the oil delivery openings 602 of the camshaft 60 and splashed in the crank room 41 flow together with a blow-by gas in the crank room 41 through the crank-room-side opening 551 of the second breather path 55 into the second breather path 55 as the piston 6 descends and pressure in the crank room 41 increases. The oil mists flow upwardly of the direction of the cylinder axial line 7 through the second breather path 55 toward the third breather path 56. Thereafter, a gas containing the oil mists which has flowed in the third breather path 56 has a flow direction changed at a right angle to the cylinder axial line 7 by the partition wall 561 and flows into the first breather path 54. The gas flows through the first breather path 54 toward the valve-mechanism-room-side opening 541 and flows in the valve mechanism room 50. Moreover, when the piston 6 ascends and the pressure in the crank room 41 decreases, the oil mists in the valve mechanism room 50 flow in the third breather path 56 through the first breather path 54. At this time, the oil mists has a flow direction changed from the vertical direction to the horizontal direction by the partition wall 561 in the third breather path 56. That is, as shown in FIG. 4, FIG. 5 and FIG. 6, the gas containing the oil mists flows through the third breather path 56 as indicated by an arrow 90. The gas containing the oil mists flows through the second breather path 55 as indicated by an arrow 91. Furthermore, the gas containing the oil mists flows through the first breather path 54 as indicated by an arrow 92.

The blow-by-gas which has flowed into the valve mechanism room 50 flows back into the air cleaner 70 through the connection path 52, and is sent into the combustion chamber 20 again. Conversely, the oil mists which have flowed into the valve mechanism room 50 adhere to a valve mechanism to lubricate the valve mechanism. Oils acquired by the liquefaction of the oil mists falls from the valve-mechanism-room-side opening 541 through the first breather path 54, and are accumulated in the concaved part 563 of the third breather path 56. The oils accumulated in the concaved part 563 are suctioned by the oil pump 63 via the oil return path 564, and delivered again through the oil delivery openings 602 of the camshaft 60 into the crank room 41.

The crank-room-side opening 551 where the oil mists in the crank room 41 flow is provided at a position opposite to the rotational plane 611 of the driven gear 61, so that the oil mists flowing in the crank-room-side opening 551 can be limited by centrifugal force generated by rotation of the driven gear 61. That is, as the driven gear 61 causes the oil mists to be less likely to go into the crank-room-side opening 551, any excessive oil supply to the valve mechanism room 50, etc., can be suppressed. Moreover, as the crank-room-side opening 551 is located in the annular recess 612 of the driven gear 61, a path through which the oil mists flow is formed in a labyrinth-like pattern. Accordingly, the oil mists in the crank room 41 become less likely to flow in the crank-room-side opening 551, so that the inflow amount of the oil mists into the second breather path 55 can be regulated. Consequently, the amount of oil mists flowing in the valve mechanism room 50 from the crank room 41 is regulated, and oil mists can be prevented from excessively flowing in the valve mechanism room 50. Furthermore, the oil mists are prevented from returning together with the blow-by gas into the air cleaner 70 through the connection path 52. Accordingly, it becomes possible for the engine 1 to prevent the oils from adhering to the air cleaner 70 and from becoming the intake resistances, and to suppress any increase of oil consumption originating from oil burning, carbon built-up in the combustion chamber and deterioration of the value of exhaust gas characteristic. Moreover, as the annular recess 612 of the driven gear 61 and the crank-room-side opening 551 formed as the tubular protrusion wall 552 protruding toward the recess 612 each has a relatively simple structure, the production cost of the engine 1 can be held down. Furthermore, as shown in FIG. 5 and FIG. 6, as the oil delivery openings 602 of the camshaft 60 are located leftward of the crank-room-side opening 551, oils delivered through the oil delivery openings 602 become less likely to flow in the crank-room-side opening 551, like the foregoing path in the labyrinth-like pattern. Consequently, any inflow of excessive oil mists in the valve mechanism room 50 can be further suppressed, so that the foregoing effect can be accomplished more efficiently. Moreover, as the first breather path 54 and the second breather path 55 are offset from each other, some of oil mists which have flowed through the first breather path 54 or the second breather path 55 and have reached the third breather path 56 have a flow direction changed from a direction parallel to the cylinder axial line 7 (the arrows 90 and 92) to a direction vertical to the cylinder axial line 7 (the arrow 91) by the partition wall 561. Accordingly, the oil mists contact the ceiling wall 562 of the cylinder-side recess 564 in the third breather path 56 or the concaved part 563 and become likely to be liquefied, and the liquefied oils are to be accumulated in the concaved part 563. The oils accumulated in the concaved part 563 are suctioned by the oil pump 63 and promptly dispersed in the crank room 41. Consequently, any excessive inflow of oil mists in the valve mechanism room 50 can be suppressed, and it becomes possible for the engine 1 to more efficiently prevent the oils from adhering to the air cleaner 70 and from becoming the intake resistances, and to suppress any increase of oil consumption originating from oil burning, generation of white smokes, carbon built-up in the combustion chamber and deterioration of the value of exhaust gas characteristic. Moreover, as the oils acquired by liquefaction and accumulation of the oil mists are circulated promptly, the oils can be used efficiently.

Note that in the foregoing embodiment, as shown in FIG. 6 and FIG. 7, although the crank-room-side opening 551 is located inwardly of the annular recess 612 of the driven gear 61, the present invention is not necessarily limited to this configuration. The position of the crank-room-side opening 551 can be selected accordingly as far as the excessive inflow of oil mists into the valve mechanism room 50 can be regulated. For example, the crank-room-side opening 551 may be located at a position inwardly of the root circle 613 of the driven gear 61 (see, FIG. 7), inwardly of an outer circumference edge 614 of the driven gear 61 (see, FIG. 7), or at a position where a part of the crank-room-side opening 551 overlaps a part of the outer circumference edge 614 of the driven gear 61 as viewed in the direction of the axial line 62 of the camshaft 60. Moreover, the area of the crank-room-side opening 551, the shape thereof, and the overlapping level of the crank-room-side opening 551 with the annular recess 612 of the driven gear 61 in the direction of the axial line 62 of the camshaft 60 are not limited to those of the foregoing embodiment, and can be set appropriately in accordance with the inflow amount of oil mists into the valve mechanism room 50.

Figure 16:
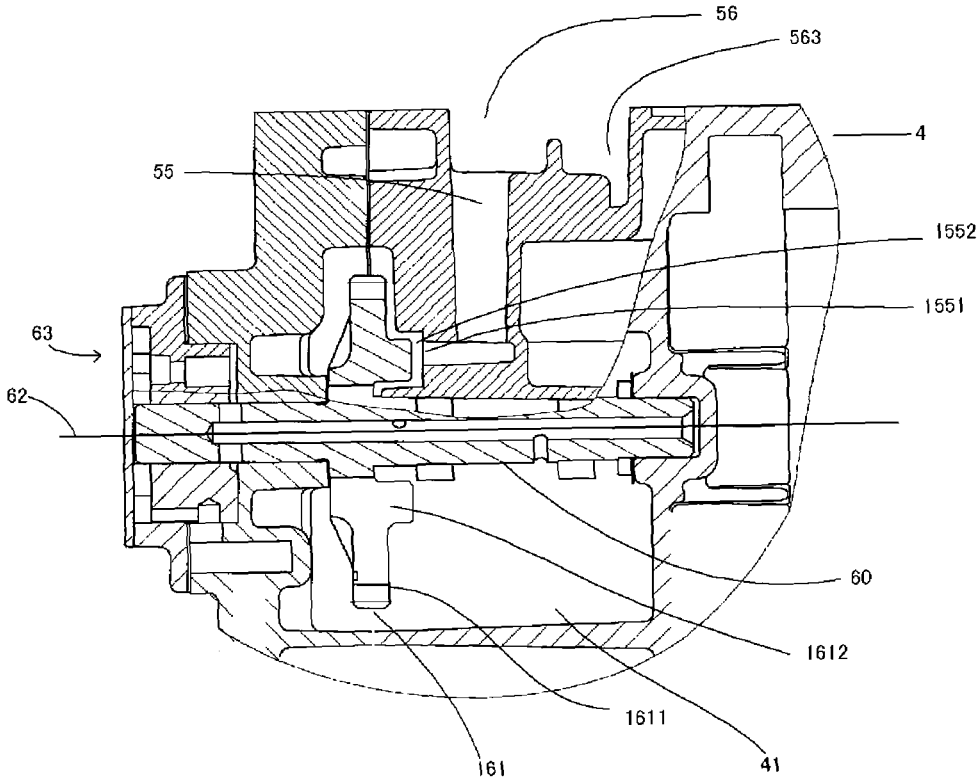

Moreover, in the foregoing embodiment, as shown in FIG. 6, although the crank-room-side opening 551 is located inwardly of the annular recess 612 of the driven gear 61 in the direction of the axial line 62 of the camshaft 60, the present invention is not necessarily limited to this configuration. For example, as shown in FIG. 16, an annular protrusion part 1612 is formed on a rotational plane 1611 of a driven gear 161, and a circular-arc recess 1552 which faces the protrusion part 1612 of the driven gear 161 and can partially cover the protrusion part 1612 is formed at a crank-room-side opening 1551. The right side end of the protrusion part 1612 in FIG. 16 may be located leftward of the leftmost side face of the recess 1552 in the direction of an axial line 62 of a camshaft 60. In this case, the crank-room-side opening 1551 is also formed in a labyrinth-like pattern between the recess 1552 and the protrusion part 1612 of the driven gear 161. Consequently, the inflow of oil mists into the crank-room-side opening 1551 can be regulated, so that the same effect as the foregoing effect can be accomplished.

Moreover, as the concaved part 563 where oils are accumulated in the third breather path 56 is formed at the crankcase side, the concaved part 563 is less affected by heat than the cylinder block 3 having the combustion chamber 20, so that any oil deterioration can be suppressed. Furthermore, as the cylinder-side recess 564 is formed in addition to the concaved part 563 at the third breather path 56, even if the engine 1 is tilted when a worker works with the bush cutter 1001, etc., oils can be temporarily accumulated in the concaved part 563 in the third breather path 56 or in the cylinder-side recess 564. In particular, even if the oils accumulated in the concaved part 563 overflows when the engine 1 is tilted sharply, the oils can be accumulated in the cylinder-side recess 564. Consequently, the oils are prevented from flowing in the valve mechanism room 50 when the engine 1 is tilted, and it becomes possible for the engine 1 to more efficiently prevent the oils from adhering to the air cleaner 70 and from becoming the intake resistances, and to suppress any increase of oil consumption originating from oil burning, generation of white smokes, carbon built-up in the combustion chamber, and deterioration of the value of exhaust gas characteristic.

Note that the offset level of the first breather path 54 with the second breather path 55, an aperture area in the third breather path 56, the depth of the concaved part 563 of the third breather path 56 or that of the cylinder-side recess 564, etc., can be selected accordingly as needed.

According to the engine 1 employing the foregoing configuration, when the engine 1 starts and the flywheel magnet 12 rotates, cooling air is produced by the cooling fan 32 formed at the flywheel magnet 12. As is indicated by arrows in FIG. 9, the cooling air is guided by the baffle plates 29 and 30, flows between adjoining cooling fins 31 formed around the cylinder head 2 and the cylinder block 3 along the cylinder head 2 and the cylinder block 3, and cools down the cylinder head 2 and the cylinder block 3.

As shown in FIG. 9, as viewed in the direction of the cylinder axial line 7, the combustion-chamber-side intake opening 27 and the combustion-chamber-side exhaust opening 28 are arranged side by side and substantially parallel to the axial line 26 of the crankshaft 10 with the combustion-chamber-side intake opening 27 being located at the flywheel magnet 12 side. Moreover, the exhaust port 22 runs from the combustion-chamber-side exhaust opening 28 in the direction apart from the axial line 26 of the crankshaft 10 and in the direction toward the muffler 25 so that the distance from the combustion-chamber-side exhaust opening 28 in the direction of the axial line 26 of the crankshaft 10 increases as becoming apart from the combustion-chamber-side exhaust opening 28. Accordingly, at respective side faces of the cylinder head 2 and of the cylinder block 3 at the muffler 25 side, as viewed in the cylinder axial line 7 direction, the cooling air flowing between adjoining cooling fins 31 formed around the cylinder head 2 and the cylinder block 3 flows in the direction of the axial line 26 of the crankshaft 10. Accordingly, the cooling air can flow over the side of the combustion chamber 20 with the flow of the cooling air not being blocked by the exhaust port 22 and by the exhaust-side opening 221. Consequently, it becomes possible for the engine 1 to efficiently cool down the vicinity of the high-temperature combustion chamber 20 by the cooling air.

In particular, as shown in FIG. 9, the exhaust-side opening 221 is located in the end of the upper side face of the cylinder head 2 at a side apart from the flywheel magnet 12. Accordingly, the path of cooling air flowing along respective upper side faces of the cylinder head 2 and of the cylinder block 3 in the direction of the axial line 26 of the crankshaft 10 can be extended. Consequently, the cooling efficiency around the cylinder head 2, the cylinder block 3, and the side of combustion chamber 20 can be improved.

Moreover, as shown in FIG. 9, as viewed in the cylinder axial line 7 direction, the intake port 21 runs to the intake-side opening 211 from the combustion-chamber-side intake opening 27 in the direction apart from the axial line 26 of the crankshaft 10 and in the direction toward the lower side face where the insulator 23 and the carburetor 24 are attached so as to come close to the outer circumference face of the cylinder head 2 facing the flywheel magnet 12. Accordingly, the flow of cooling air produced by the cooling fan 32 along respective side faces of the cylinder head 2 and of the cylinder block 3 at the carburetor 24 side is to be blocked by the intake port 21 and by the intake-side opening 211. Some of such blocked flows go along respective side faces of the cylinder head 2 and of the cylinder block 3 both facing the cooling fan 32. Thereafter, the flows go along respective side faces of the cylinder head 2 and of the cylinder block 3 both facing the muffler 25. Consequently, more cooing air can be guided to the respective side faces of the cylinder head 2 and of the cylinder block 3 both facing the muffler 25, thereby cooling down the cylinder head 2 and the cylinder block 3 further efficiently.

Moreover, as shown in FIG. 9, the spark plug mounting hole 33 to mount the non-illustrated spark plug is formed at the right of the intake port 21 in FIG. 9. Accordingly, even if cooling air is blocked by the intake port 21 and by the intake-side opening 211 and the flow of the cooling air to the periphery of the spark plug is reduced, it is also possible to accomplish a further effect that the intake port 21 which is cooled as a low-temperature air-fuel mixture flows can cool down the periphery of the spark plug. Furthermore, because the spark plug is located in the lee of the intake port 21, cooling air becomes less likely to flow to the spark plug as being blocked by the intake port 21, so that any excessive cooling of the spark plug by the cooling air can be suppressed.

Moreover, the muffler 25 has the substantially flat rectangular solid shape, and as shown in FIG. 9, the face of the muffler 25 having the largest area is arranged so as to face the upper side face of the cylinder head 2. Accordingly, together with the baffle plate 29, cooling air can be guided along the respective side faces of the cylinder head 2 and of the cylinder block 3, so that the cylinder head 2 and the cylinder block 3 can be cooled down efficiently.

Moreover, as shown in FIG. 10, the exhaust inflow opening 251 is provided at a position corresponding to the exhaust-side opening 221 of the cylinder head 2 in the vicinity of the upper left end of the face of the muffler 25 facing the cylinder head 2. Furthermore, the connection path 255 is provided in the vicinity of the lower right end of the partition wall 255 which partitions the interior of the muffler 25 into the first room 253 and the second room 254, and the exhaust outflow opening 256 is provided in the right side face of the second room 254 in FIG. 9. Accordingly, exhaust air which flows in the muffler 25 through the exhaust inflow opening 251 goes within the muffler 25 from the vicinity of one end in the muffler 25 to the vicinity of the other end thereof in the direction of the axial line 26 of the crankshaft 10. That is, as the exhaust air goes through a long path via the first room 253, the connecting path 255, and the second room 254, exhaust sounds are muffled. Consequently, the dimension of muffler 25 in direction of the cylinder axial line 7 can be reduced with a sound-deadening effect being maintained. Accordingly, it becomes possible to greatly improve the degree of freedom for the designing of the engine or of the whole engine-driven tool equipped with that engine, e.g., the bush cutter.

Note that in the foregoing embodiment, as shown in FIG. 9, the exhaust port 22 runs toward the exhaust-side opening 221 located in the end of the upper side face of the cylinder head 2 at a side apart from the flywheel magnet 12. However, the position of the exhaust-side opening 221 is not limited to the vicinity of the right end of the upper side face of the cylinder head 2 in FIG. 9, and the exhaust-side opening 221 may be located at a position shifted leftward from the right end. Moreover, regarding the intake port 21, as far as a space where the spark plug mounting hole 33 to mount the spark plug is formed can be secured, the intake port 21 may also run leftward of the lower side face of the cylinder head 2 relative to the intake port 21 shown in FIG. 9.

In the engine 1 to which the first gasket 126 is attached, when the piston 6 descends and the intake valve 18 opens, air-fuel mixture flows through the intake path 241 of the carburetor 24 and through the intake path opening 261 of the first gasket 126 at a fast speed. Accordingly, the outer circumference part of the intake path 241 and that of the intake path opening 261 become negative pressure, and such negative pressure is transmitted to the pulse hole 242 of the carburetor 24 from the first connection 264 of the first gasket 126 through the pulse pressure communication path 267. Conversely, when the intake valve 18 is closed, the interior of the intake path 241 and that of the intake path opening 261 become atmospheric pressure. Such atmospheric pressure is transmitted to the pulse hole 242 of the carburetor 24 from the first connection 264 of the first gasket 126 through the pulse pressure communication path 267. Consequently, a pressure fluctuation originating from opening/closing of the intake valve 18 can be transmitted to the pulse hole 242 of the carburetor 24, so that the diaphragm of the carburetor 24 can be actuated, thereby supplying fuel to the carburetor 24.

The carburetor 24 and the first gasket 126 adjoin each other. Accordingly, when two position: one between the intake path 241 of the carburetor 24 and the intake path opening 261 of the first gasket 126, and another between the pulse hole 242 of the carburetor 24 and the pulse communication hole 262 of the first gasket 126 are positioned, and when the carburetor 24 is attached to the first gasket 126, the diaphragm of the carburetor 24 can be easily actuated. The carburetor 24 is attached to the insulator 23 together with the first gasket 126 by means of a common screw. Accordingly, positioning of the foregoing two positions can be easily accomplished. This facilitates the assembling work of the engine 1, so that the production cost thereof can be reduced. Moreover, as the first gasket 126 is thicker than other gaskets, it is possible to prevent the first connection 264, the pulse pressure communication path 267, and the pulse communication hole 262 from being collapsed at the time of assembling work of the carburetor 24, so that any interruption of the transmission of a pressure fluctuation can be suppressed. From this point, the assembling work can be also facilitated, the pressure fluctuation can be surely transmitted, and the production cost can be further reduced.

Moreover, in a condition in which the carburetor 24 is attached to the engine 1, as shown in FIG. 14, the first connection 264 of the pulse pressure communication path 267 of the first gasket 126 is connected to the upper end of the intake path opening 261 with a direction from the bottomdead center of the cylinder axial line direction toward the topdead center thereof being up. The pulse pressure communication path 267 reaches the pulse communication hole 262 through the extending part 265 which runs upwardly from the first connection 264 and through the direction changing part 266 which is connected to the extending part 265 and runs toward the lower right direction. Accordingly, even if some of air-fuel mixture is liquefied in the intake path 241, such liquefied fuel is less likely to go into the first connection 264, so that any interruption of the transmission of a pressure fluctuation to the diaphragm of the carburetor 24 can be suppressed. This ensures transmission of the pressure fluctuation. Moreover, when the engine 1 is tilted, even if the liquefied fuel come into the pulse pressure communication path 267, such liquid is discharged from any end by the extending part 265 and the direction changing part 266. Consequently, this prevents the liquid from being accumulated in the interior of the pulse pressure communication path 267 and from interrupting the transmission of the pressure fluctuation.

Figure 17:
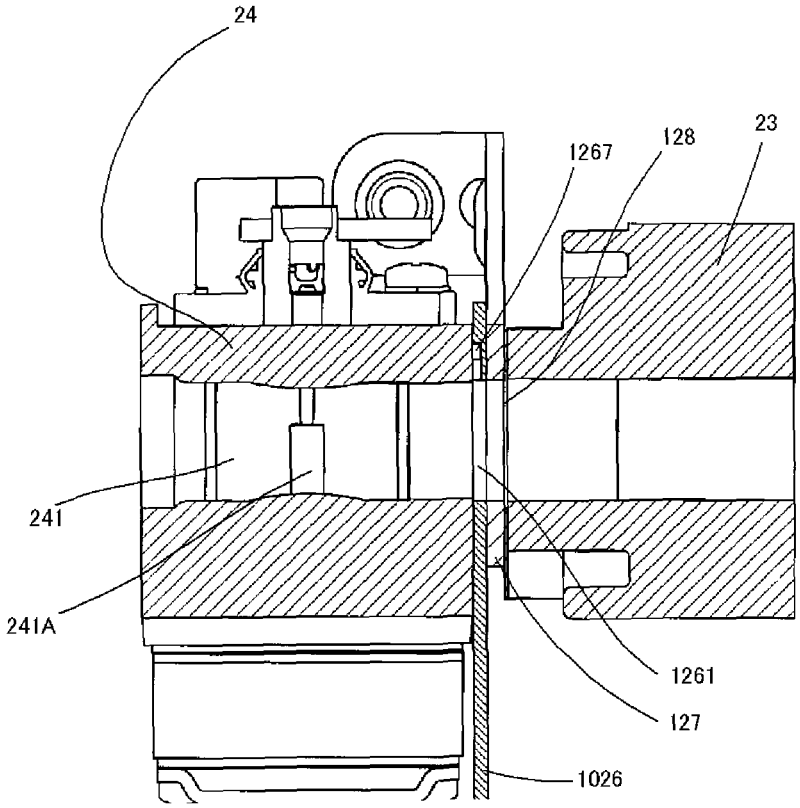

In the foregoing embodiment, although the intake path opening 261 of the first gasket 126, the mounting hole 263, the pulse communication hole 262, and the pulse pressure communication path 267 are all formed so as to pass all the way through the first gasket 126 in the thickness direction, the present invention is not limited to this configuration. For example, as shown in FIG. 17, a first connection (not illustrated), a pulse communication hole (not illustrated), and a pulse pressure communication path 1267 may be formed in a concave groove-like shape at a plane of the first gasket 1026 facing the carburetor 24, and in this case, the same effect as the foregoing effect can be also accomplished.

Moreover, in the foregoing embodiment, in the attached state of the carburetor 24 to the engine 1, the position of the pulse hole 242 of the carburetor 24 and that of the pulse communication hole 262 of the first gasket 126 are respectively located below the intake path 241 and the intake path opening 261 with the direction from the bottomdead center of the cylinder axial line direction toward the topdead center thereof being up. However, the present invention is not necessarily limited to this configuration. For example, the pulse hole 242 and the pulse communication hole 262 may be located below the first connection 264. Even in such case, the extending part 265 and the direction changing part 266 can prevent fuel liquefied in the intake path 241 from clogging the pulse pressure communication path 267, thereby suppressing any occurrence of interruption of the transmission of a pressure fluctuation.

Note that in the foregoing embodiment, although the engine 1 is carried by the bush cutter 1001, to which tool the engine 1 is carried is not limited to the bush cutter 1001, and the engine 1 can be carried by other engine-driven tools, such as a chain saw, a blower, and a hedge trimmer.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

This application claims the benefit of Japanese Patent Application No. 2009-229137 filed on Sep. 30, 2009 and Japanese Patent Application No. 2009-229139 filed on Sep. 30, 2009, the entire disclosure of which is incorporated herein by reference in their entirety.

REFERENCE SIGNS LIST

1 Engine
3 Cylinder block
4 Crankcase
6 Piston
10 Crankshaft
11 Starter mechanism
12 Flywheel magnet
21 Intake port
22 Exhaust port
23 Insulator
24 Carburetor
25 Muffler
27 Combustion-chamber-side intake opening
28 Combustion-chamber-side exhaust opening
31 Cooling fin
32 Cooling fan
33 Spark plug mounting hole
41 Crank room
42 Oil room
4 Vertical partition wall
43 Horizontal partition wall
45 Communication path
50 Valve mechanism room
60 Camshaft
70 Air cleaner
126 First gasket
241 Intake path
242 Pulse hole
261 Intake path opening
262 Pulse communication hole
264 First connection
267 Pulse pressure communication path

The invention claimed is:

1. A four-cycle engine comprising:

a cylinder block which includes a cylinder bore retaining a piston moving back and forth;

a crankcase which is attached to the cylinder block and which rotatably supports a crankshaft;

a partition wall which partitions an interior of the crankcase into a crank room retaining the crankshaft and an oil room retaining an oil that lubricates the crankshaft;

a communication path which communicates the crank room with the oil room and which guides oil in the crank room to the oil room; and an oil supply unit which supplies the oil in the oil room into the crank room, wherein a cross section of the partition wall is formed in a substantially V shape with an apex being located downward, given that a direction in which the piston goes from a bottom dead center toward a top dead center is upward as crankshaft is viewed in an axial direction downwardly, and the communication path is formed at the apex, the communication path is located leftward of a plane which passes through an axial line of the crankshaft and includes an axial line of the cylinder bore as the crankshaft is viewed in a clockwise direction, the partition wall comprises a first partition wall and a second partition wall which are spaced apart from each other at the apex, the communication path is defined by the first partition wall and the second partition wall, the second partition wall extends in the vertical direction, wherein an end of the first partition wall at the apex side is located leftward of an end of the second partition wall, or in the same plane of the second partition wall, at the apex side as the crankshaft is viewed in a clockwise direction, and wherein the oil room is defined by the partition wall and an external wall of the crankcase.

2. The four-cycle engine according to claim 1, wherein the communication path is located at a lower end of the crank room.

3. The four-cycle engine according to claim 1, wherein the first partition wall is tilted so that an end at an apex side is located at a lowermost position.

4. The four-cycle engine according to claim 1, wherein the oil room includes a first oil room which is defined by the first partition wall of the partition wall and an external wall of the crankcase, and a second oil room which is defined by the second partition wall of the partition wall and the external wall of the crankcase.

5. A bush cutter equipped with the four-cycle engine according to claim 1, wherein:

an output shaft of the four-cycle engine for driving a reel of the bush cutter is on the same side as a back portion of the crankshaft as the crankshaft is viewed in a clockwise direction, and the reel of the bush cutter is configured to rotate in a counterclockwise direction as the reel in a usage state is viewed from the above.

6. An engine-driven tool comprising the four-cycle engine according to claim 1.

* * * * *